US005151132A

United States Patent [19]

Zimmer

[11] Patent Number: 5,151,132

[45] Date of Patent: * Sep. 29, 1992

[54] ARRANGEMENT FOR APPLYING SUBSTANCES TO A WEB OF MATERIAL

[76] Inventor: Johannes Zimmer, Ebentaler Str. 133, A-9020 Klagenfurt, Austria

[ * ] Notice: The portion of the term of this patent subsequent to May 1, 2007 has been disclaimed.

[21] Appl. No.: 474,838

[22] PCT Filed: Jan. 5, 1990

[86] PCT No.: PCT/AT90/00002

§ 371 Date: Sep. 10, 1990

§ 102(e) Date: Sep. 10, 1990

[87] PCT Pub. No.: WO90/07387

PCT Pub. Date: Jul. 12, 1990

[30] Foreign Application Priority Data

Jan. 9, 1989 [AT] Austria ..... 33/89
Sep. 8, 1989 [AT] Austria ..... 2112/89

[51] Int. Cl.[5] ..... B05C 11/04; B41F 15/44

[52] U.S. Cl. ..... 118/126; 101/120; 118/406; 118/413; 118/414; 118/419

[58] Field of Search ..... 118/126, 213, 406, 413, 118/414, 419; 101/119, 120

[56] References Cited

U.S. PATENT DOCUMENTS 3,216,349 11/1965 Kraft ..... 101/120 X
3,988,986 11/1976 Zimmer ..... 118/406 X
4,014,289 3/1977 Zimmer ..... 118/213
4,036,129 7/1977 Zimmer ..... 101/120
4,920,914 5/1990 Zimmer ..... 118/419

FOREIGN PATENT DOCUMENTS 2302084 7/1974 Fed. Rep. of Germany .
3001073 6/1981 Fed. Rep. of Germany .

*Primary Examiner*—Michael G. Wityshyn
*Attorney, Agent, or Firm*—Herbert Dubno

[57] ABSTRACT

In an arrangement for the application of substances to a web of material (4), whereby a doctor blade (9, 13) is magnetically pressed against the material or a stencil (5) by means of a working magnet, and rests against a profiled ledge (6) in its operational position, it is proposed that in the profiled ledge (6) at least one restraining magnet (7) be provided, which keeps the doctor blade (9, 13) in rolling or sliding contact with the profiled ledge when the working magnet is switched off and raises it from the application surface (4, 5) or stencil.

32 Claims, 4 Drawing Sheets

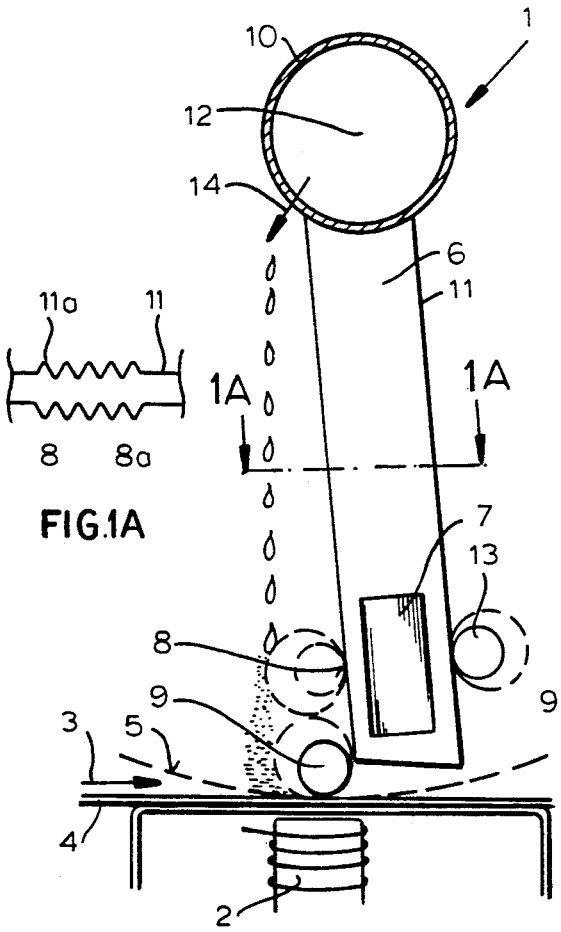
FIG.1A
FIG.1
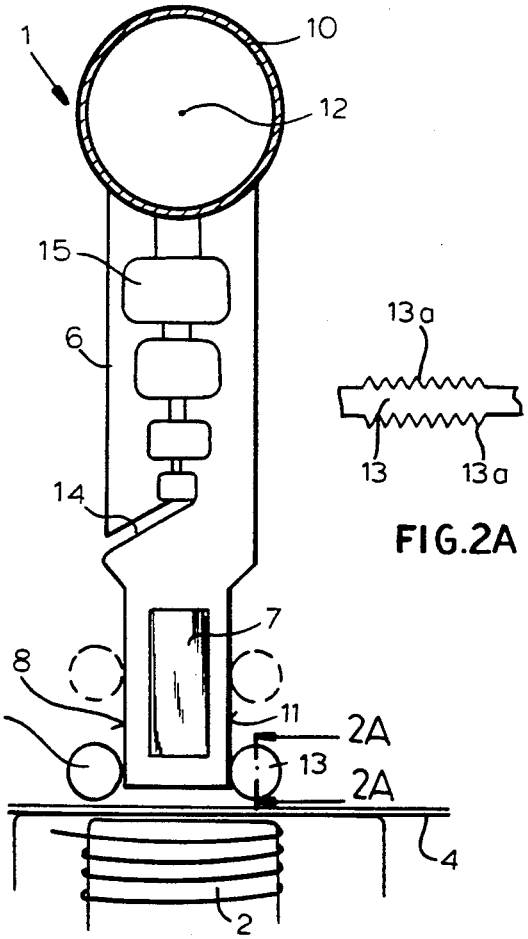
FIG.2A
FIG.2
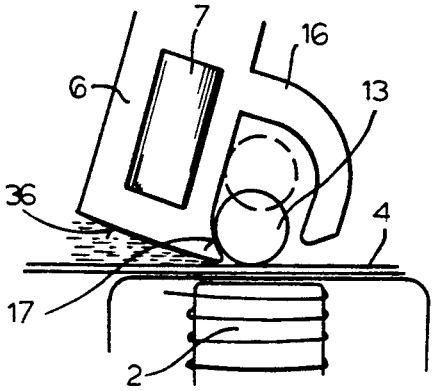
FIG.3
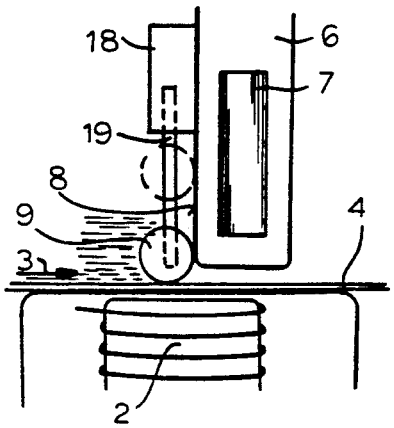
FIG.4

ARRANGEMENT FOR APPLYING SUBSTANCES TO A WEB OF MATERIAL

FIELD OF THE INVENTION

The invention relates to an arrangement for applying substances to a web of material, whereby a doctor blade is magnetically pressed against the material or a stencil by means of a work magnet and, when in working position, comes to lie against a profiled ledge.

THE RELATED ART

It is already known to arrange a magnetic table or a magnetic roller to face a doctor roll, so that the doctor blade made of a magnetizable material will be pressed against the web of material, respectively the stencil, and will apply to the web of material the substance supplied in front of it, when the web, respectively the stencil, continues to move. In order to prevent a deviation of the doctor roll, it has already been proposed to provide a support ledge behind the doctor roll; this is of interest particularly in the case of rollers with a small diameter, since it can prevent the substance to be applied from flowing back over the upper region of the roll, and this way to reach also the web of material behind the doctor roll. In another embodiment, a so-called baffle ledge for the dye is arranged in front of the roller, seen in the travel direction of the web of material, and this dye-stopping ledge influences the application process, depending on position and location, i.e. distance to the application plane.

A drawback of this state of the art consists in the fact that when the process is interrupted, the doctor-blade elements and the profiled ledge have to be handled separately, which requires more work, and that when doctor roll with a high ratio between diameter and length are used, there is the danger of bending them out of shape, making it impossible to reuse them. The smaller the diameter and the bigger the length, i.e. in the case of large work widths, the bigger the danger of bending and the more attention has to be given to the handling of the doctor rolls. The invention aims at eliminating these drawbacks of the state of the art by creating an arrangement which can be handled as a functional unit and wherein the danger of bending the doctor rolls with small diameters can be avoided as much as possible.

SUMMARY OF THE INVENTION

The invention is characterized in that in the profiled ledge at least one retaining magnet is provided, which keeps the doctor blade in rolling or sliding contact with the profiled ledge, when the working magnets are switched off, and lifts the doctor blade from the application surface, respectively the stencil.

Due to the invention, it has become possible to handle the doctor-blade elements and the profiled ledge as a functional unit. Further, it is no longer necessary in case of an interruption of the process, to either stop the motion of the stencil or to remove the doctor blade from the stencil, since as a result of the fact that the doctor blade is lifted at the moment of interruption, the stencils can continue to turn, without any undesirable effects. Besides, a self-positioning of the profile ledge, and thereby of the doctor-blade element, takes place and it is now possible to use a great variety of doctor blades and also to select doctor rolls with a great variety of diameters.

BRIEF DESCRIPTION OF THE DRAWINGS

The invention is described in greater detail with the aid of the accompanying drawing.

FIGS. 1 and 2 show two embodiment examples of the arrangement according to the invention.

FIG. 1A is a sectional view of the support surfaces of the ledge along lines 1A—1A in FIG. 1. FIB. 2A is a sectional view of the doctor device taken along lines 2A—2A in FIG. 2.

FIG. 3 shows a detail, pertaining particularly to the embodiment according to FIG. 1.

FIGS. 4, and 5 to 8, as well as FIGS. 9 to 14, show further embodiments of the invention.

DETAILED DESCRIPTION

Figure 6:
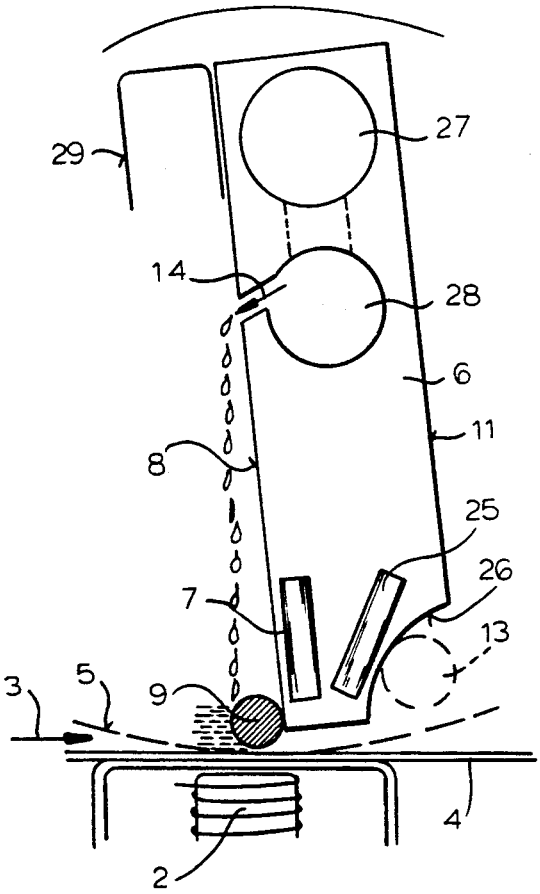

FIG. 1 shows an arrangement 1 of the simplest construction. A profiled ledge 6 is rotatably arranged over a magnetic table 2, on which a web of material 4 is guided in the travel direction 3. At a distance from the lower end of the profiled ledge 6, a permanent-magnet ledge 7, or optionally several permanent magnets arranged in a row, are provided. Preferably, the permanent-magnet ledge 7 or the row of permanent magnets are completely surrounded by the material of the profiled ledge 6. The profiled ledge 6 having a structured surface of support surfaces 8 and 11 with respective grooves **8*a* and 11*a* seen in FIG. 1A is fastened to a substance-supply pipe 10 and rotation can take place around axis 12 of the pipe. As can be seen from the drawing, the profiled ledge 6 ends in front of the stencil 5, respectively at a distance from the web of material 4**. In addition to the rotatability, it is also possible to provide height-adjustment, in order to insure the adjustment to material with various thickness or to various diameters of the rollers.

On the front surface 8 of the profiled ledge, considered in the direction of travel there is a doctor roll 9, which during operation is pressed against the stencil 5, respectively the web of material 4 by the magnetic table 2. When the working magnet in the magnetic table 2 is turned off, the permanent-magnet ledge 7 starts to operate and the doctor roll 9 is lifted off the stencil 5, respectively the web of material 4 and kept in this lifted position by the permanent-magnet ledge 7 against the surface 8. i.e. that the doctor roll 9 is kept against the surface 8 in the operational state (continuous line), as well as in turned-off state ( broken line in the drawing), namely independently of the diameter size of the doctor roll, so that the diameters can be selected as small as 3 mm. The smaller the diameter, respectively lower the weight, the stronger and more secure is the hold on the doctor element, and that is true even when the device is washed. In FIG. 1, there is also an additional doctor element 13 provided on the rear surface 11 considered in the travel direction 3, so that the arrangement can also be used as a baffle or sealing ledge. Due to the fact that the profiled ledge 6 is rotatable, during operation the angle of substance accumulation in front of the doctor roll 9 can be varied, and thus the result of the application, can be changed.

The surface of the doctor roll or of the structure bar can be structured improving thereby the uniformity of application of the flowable medium to the surface to be covered.

In addition, as shown in FIG. 2, it is possible to provide at the same time, on each the front surface 8 and the rear surface 11, a doctor roll 9, respectively 13. Due to minimal turning, either the doctor roll 9 or the doctor roll 13 can be brought over the middle of the magnetic table 2, and when in operation, pressed against the stencil 5, respectively the web 4. The doctor element 9, respectively 13, which is not in use, is lifted off the stencil 5 or web 4 by the permanent-magnet ledge 7, and maintained in this raised position. Additionally, a transverse distributor 15 is incorporated in the profiled ledge 6, i.e. channels with ramifications and whose diameter is increasingly smaller, whereby the substance reaches the area in front of the profiled ledge 6, through the outlet 14. If a doctor element 13 is also provided at the rear surface 11, a buffer support 16 as shown in FIG. 3 can also be provided. It is possible to provide an outer periphery of the doctor device with a structured surface having respective ridges 13*a* shown in FIG. 2A. In order to achieve an adhesion or rolling contact of the doctor element 13, the end portion of the profiled ledge 6 is formed by nose 17 and provided with a rounding.

Figure 5:
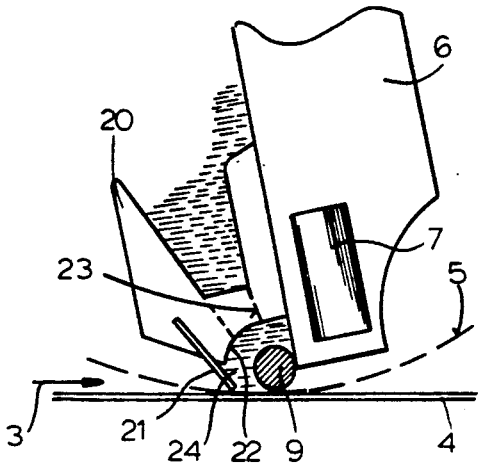
Figure 8:
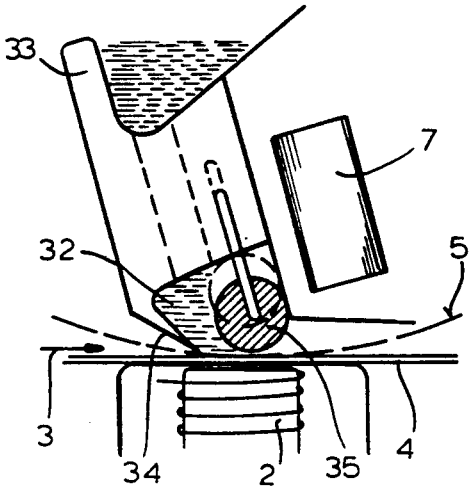

In FIG. 2, the roller 13 can go over the substance applied by roller 9 and apply additional pressure to it, or, if the roll 13 is a substance spreading blade as shown in FIG. 5 or 8, to spread the substance further.

FIG. 4 shows a further advantageous arrangement, which has become possible due to the present invention. As a result of the invention, it becomes possible to use also nonrotatable, round and/or otherwise profiled, distortion-sensitive doctor elements, which opens new possibilities for the application process. According to the state of the art, up to now it was not possible to use loosely inserted spreading blades. As can be seen from FIG. 4, on the profiled ledge 6 a holder 18 is fastened. The fastening can be done mechanically, e.g. by a screw, but also magnetically, by permanent magnet 7. In the holder 18 is inserted a rod 19, which carries the actual doctor blade 9 nonrotatably, but movable in a vertical direction. In the operation state, the doctor blade made of a magnetizable material is pulled downwardly and pressed against the web 4 or stencil 5. When the device is switched off, the permanent-magnet ledge lifts the doctor element 9 in the raised position shown in broken lines.

The rotational shutdown of round bars is a novel step, which has a surprising effect. The arresting of the roll, i.e. actually the functional transformation of a doctor roll in a round doctor blade results in a measurable change in the amounts to be applied of any particular substance. Consequently, this technologically highly valuable application technique becomes even more flexible and versatile in its application, without any significant cost. Of course it is also possible to design the doctor element as a doctor knife, which is slidably raised and lowered on the surface 8. A further possibility is to connect nonrotatably a round profiled rod, preferably with a very small diameter, onto a profiled rod having a rectangular cross section, which is loosely arranged in a holder and secured against stalling.

FIG. 5 shows a further embodiment. Here, another profiled body 20 is mounted to the profiled ledge 6. This body carries a doctor blade 21, which is pressed against the stencil 5 or the web of material 4. Further, in the profiled body 20 there is provided a molding 22, forming the space for receiving a doctor roll 9. The substance is brought into this space through openings 23. The quantity and quality of the application can be controlled through the doctor blade 21 made of steel or plastic material. This arrangement is particularly advantageous for highly fluid substances and for small quantities. By selecting the diameter of the doctor roll 9, it is possible to adjust the effective outlet port for the substance to the stencil 5 or the web 4. The outlet port is marked with the numeral 24.

A further embodiment is illustrated in FIG. 6. Here, two permanent-magnet ledges, respectively two rows of permanent magnets 7 and 25 are provided. By selecting a second row of permanent magnets or a second permanent-magnet ledge 25, it is possible to receive a doctor element 13 in a molding 26, also on the rear surface 11 of the profiled ledge 6. In this embodiment example, the individual permanent magnets can be narrower than in the embodiments of FIG. 1 and 2 and thereby brought closer to the corresponding abutting surface 8 and 11. This way, the magnets are more effective. Furthermore, it is possible to impart a convexity to the abutting surfaces and the contact area with the doctor elements 9 and 13. In this embodiment, in addition to the main supply line 27, there also is provided a transverse distributor pipe 28, which is centrally supplied and delivers the substance over outlets 14. In an improved version, the profiled ledge can be rotated by 180°, so that the substance residues can be drained through channel 29.

Figure 7:
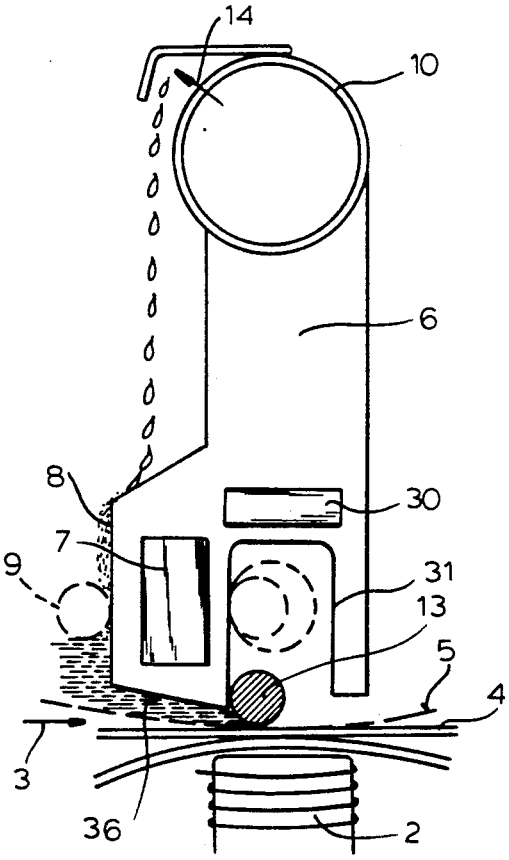

FIG. 7 is another embodiment of the invention. Here, in the profiled ledge is formed a recess 31 wherein also a doctor blade is located. The retaining magnet 7 between the recess 31 and the frontal surface 8 causes the doctor blade at the surface 8 as well as the doctor blade in the recess 31 to press against the neighboring surface and to be lifted off the stencil 5 or the web 4, when the working magnets are switched off. The recess 31 can also be built like a friction bearing. Additionally, above the recess 31 a second permanent magnet 30 can be present, which then additionally acts upon the doctor blade 13. Here also it is possible, when two doctor blades , namely 9 and 13 are available, to bring one of these doctor blades at a time in the rest position, which is achieved by rotating or displacing the profiled ledge 6. Of course, here too it is possible to perform a roll fixation, so that then a round spreading bar is obtained. Also the insertion of profiled bars with various profiles or of a spreading blade is possible.

FIG. 8 shows an embodiment wherein the profiled ledge 6 is provided with an additional ledge 33, carrying a blade 34 at its lower end, this way defining a dye space 32. In the dye space, a nonrotatable round doctor knife 35 is provided.

When the doctor element, e.g. the doctor roll 13 is pressed against the rear surface 11 of the profiled ledge 6, the lower surface 36 of the profiled ledge 6 can be used as a baffle surface. This can be seen clearly particularly in FIG. 3. This baffle surface exerts a pressure on the substance to be applied located between the baffle surface 36 and the stencil 5 or web 4, and this pressure assists the application process. The effect of the baffle surface 36 increases, when the profiled ledge 6 is brought closer to the application surface or the stencil. During operation of the device, the angle of substance accumulation in front of the doctor element , i.e. the surface 36 and thereby the results of the application, can be controlled by swivelling the profiled ledge 6. Through this angle of substance accumulation the pressure exerted upon the substance can be controlled and in this way the amount of substance applied to the surface unit can be monitored.

Since according to the invention it is possible to alternately work with the frontal doctor element 9 resting against the surface 8 or with the doctor element 13 resting against surface 11, depending on the position assumed in its rotation by the profiled ledge 6, the major resulting advantage is that it is possible to apply the material sparingly in the first case, and abundantly in the latter case. This way, due to the invention, there are multiple possibilities to influence the application process in a simple way. Firstly the profiled ledge 6 can be used as a holding ledge for a doctor element as well as a baffle and sealing ledge. Secondly there is the ability of the profiled ledge to operate with a great variety of doctor elements that can be inserted in a simple way. Furthermore, the use of the profiled ledge 6 as a baffle ledge makes possible a further control of the applied amounts of substance in a simple manner, by changing the angle of substance accumulation or the distance of the profiled ledge to the stencil 5 and the application surface.

When the magnet in the magnetic table 2 is wide, the magnet in the magnetic table 2 can act upon both doctor elements 9 and 13 on both sides of the profiled ledge 6. Here it becomes then possible to hold the doctor elements 9 and 13 on both sides of the profiled ledge 6 in operational or rest position In addition to the advantage of using a variety of doctor blades, the invention affords also the advantage that the stencil can continue to rotate even during production breaks, due to the raising of the doctor blade. Moreover, a self-positioning of the profiled ledge 6 and thereby of the doctor blade occurs. It is possible to select doctor rolls with a great variety of diameters and their cleaning and handling is performed almost like that of a "single-component" device.

Figure 9:
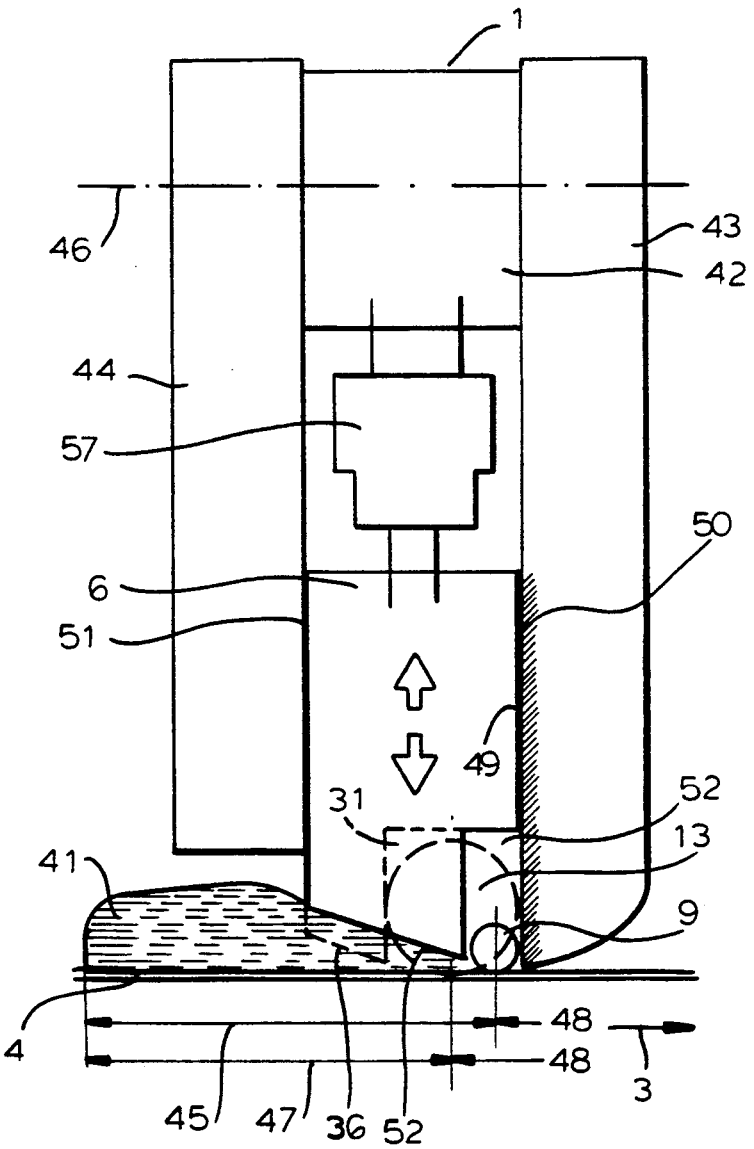

FIG. 9 shows a general cross section through an application arrangement 1 according to the invention, in a simple embodiment having few components. On an application machine not shown in the drawing, a stable crossbeam or wing spar 42 with a rectangular cross section is supported on both machine sides in a height-adjustable and in any case swingable manner. Within the range of the application width of the machine, on this crossbeam 42, two profiled ledges 43 and 44 of a material as resistant to bending as possible are attached for instance by screw connections, in order to form with the crossbeam 42 a U-beam support open towards the application surface 4.

It is conceivable that instead of a ledge 44 continuously running over the entire application width, only a few narrow ledges can be attached. The narrow holding ledges 43 and 44 do not necessarily have to be fastened to the crossbeam 42, but may also for instance be directly connected to one another.

In this aforedescribed supporting beam with the U-shaped cross section according to FIG. 9, on the side facing the application surface 4, height-adjustable baffle ledge 6, (which optionally can also be a baffle and sealing ledge) and which in FIG. 9 is located inside the U-beam, is arranged so that its surface 49 rests against the profiled ledge 43 sealingly pressed against the sealing surface area 50 of the profiled ledge 43. If the ledge 44 is a profiled ledge running over the full working width, the surface 51 resting against the profiled ledge 44 can also be designed to seal off the substance at the baffle ledge or baffle and sealing ledge 6, since it is conceivable that the substance to be applied can rise along the surface 51, in the case of high web or application speeds. The travel direction of the web 4 is indicated by an arrow 3. It is also possible that the web 4 is fixed and that the entire application device 1 travels over the surface to be coated in a sense contrary to direction 3.

In FIG. 9, the area in front of the application device which is in contact with the substance 41 to be applied is marked with 45 where the shown doctor roll 9 with a small diameter is used, and with the numeral 47 where the roll 13 with a large diameter is used, as shown in broken lines in FIG. 9.

In the aforedescribed examples, 48 and 48' mark the respective areas following the doctor element, respectively its contact line or zone on the application surface. The support surface which forms a countersupport for the doctor element—in FIG. 9 doctor roll 9 or 13—and under which during the process a magnetic field acts upon the magnetizable doctor elements 9, 13, in order to press them thereagainst, is not shown in FIG. 9.

The doctor roll 9 may, in one aspect of the invention, itself be a permanent magnet, whereby magnetizable parts are provided in surrounding areas of the profiles ledge 43 and/or baffle ledge 6.

Also in FIG. 9 it is shown that a narrow free-motion space 52 and a relatively wider substance-accumulation surface 36 is assigned to the doctor element 9 and that to the wider doctor element or roller 13 a bigger free-motion space 52 corresponding to its size and a narrower baffle surface 36 is assigned, which is closer and more efficiently reaches towards the application surface.

Figure 10:
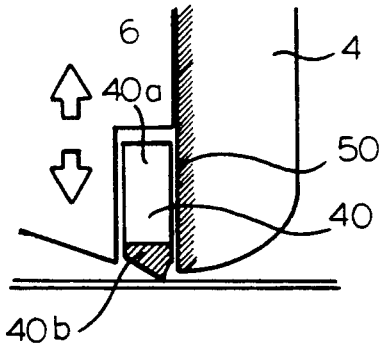

FIG. 10 shows that the doctor element pressed down by magnetic force does not necessarily have to be a doctor roll, but it can also be for instance a profiled spreading ledge 40 with an approximately rectangular or trapezoidal cross section, which can be considered as a doctor element having the same functions, respectively corresponding to the invention, regarding the magnetically produced pressure as well as its sealing adhesion to the sealing area 50 of the ledge 43. Also the height-adjustability of the profiled ledge 6, which is again shown in FIG. 10, is functionally identical to the one shown in FIG. 9, as well as in other figures.

The profiled spreading ledge 40 shown in FIG. 10 has several incision in the area **40*a* over its entire length corresponding to the application width, so that only the hatched portion 40*b* of the profiled ledge 40** facing the application area and provided with the doctor profile remains undivided, i.e. continuously massive over the entire length of the profiled bar. As a result of this measure proposed by the invention, a possible bending or bending danger impairing an even application can be avoided as a result of higher inherent rigidity.

Figure 11:
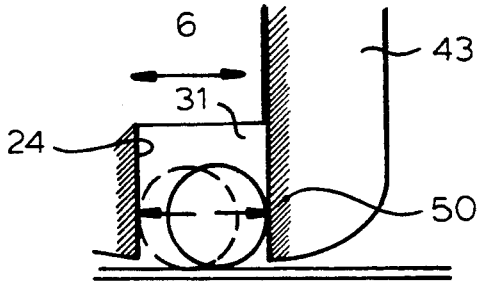

FIG. 11 shows a cutout from FIG. 9 but with a larger free-motion space 52 for the doctor element. In this FIG. 11, the doctor element is a doctor roll, whose diameter is larger than 14 and smaller than 16 centimeters.

In this FIG. 11 it is shown that the doctor element can rest against the support and sealing area 50 of the ledge 43 or against the opposite surface 24 of the ledge 6, depending on the setting of the machine or setting of the application arrangement. Surface 24 can also be a support and sealing ledge, like the area 50 of the ledge 43

Figure 12:
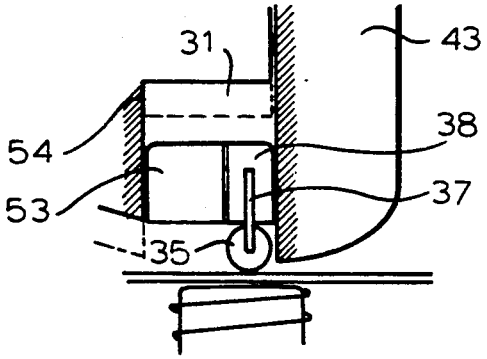
FIG. 12A is an embodiment showing two doctor devices one on top of the other according to the invention.

In FIG. 12, a profiled bar 35 with circular cross section (thus similar to a doctor roll) is shown as the doctor element However, this rounded-profile spreading bar 35 is secured by a plug connection to profiled ledge 38, in order to prevent rotation. Ledge 38 which optionally can be made of a magnetizable material is connected with a ledge 53 which fills the free-motion space 52 reaching up to the surface 54, so that the profiled doctor ledge widened by the aforedescribed additional ledges 38 and 53 (which in this cross-section shape can of course consist only of one or two components) is pressed against surface 54 slidingly and optionally also sealingly.

Figure 12A:
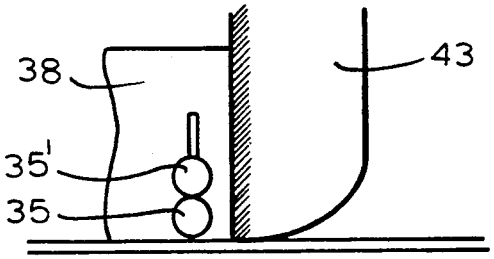

It is possible to provide two rollers 35 and 35' one on top of the other as shown in FIG. 12A.

Figure 13:
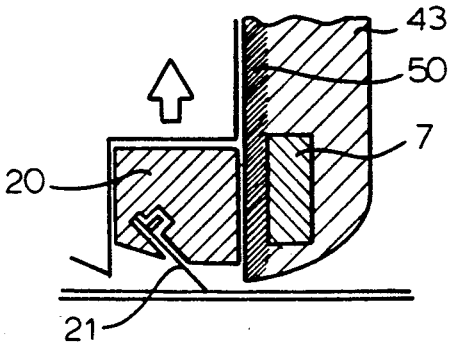

In FIG. 13, a spreading profiled ledge 20 is shown, which is provided with a flexible spreading edge 21, deformable in correspondence to the compression force applied to the doctor blade As a further feature of the invention, in the ledge 43 a permanent-magnet ledge 7, or a functionally identical row of permanent magnets arranged next to each other have been incorporated. This measure leads to the fact that the ledge 20 is magnetically adherent to the surface 50 even when the device is not operating, which has a favorable influence on its handling. The ledge 20 can not fall out, when the device is assembled or disassembled, or during transportation, and the device assisting the application and the doctor elements can be commonly handled, just like a single component.

Figure 14:
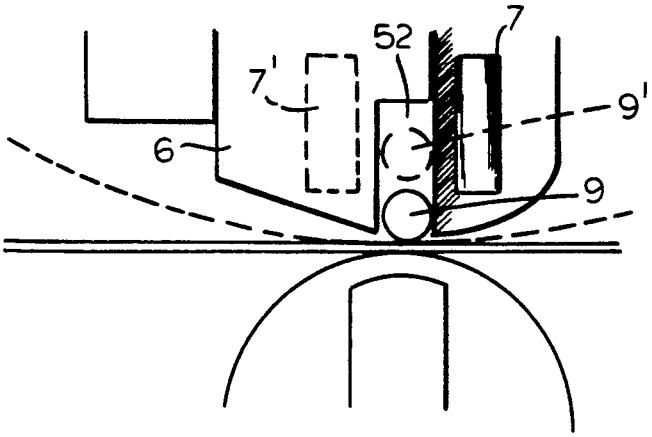

FIG. 14 shows a combination of the representations of FIG. 10 and 13. In the narrow free-motion space 52, a doctor roll of small diameter is inserted, whose operational application position is marked with 9 and the position in which it is removed from the application surface, respectively stencil and magnetically fastened is marked with 9'. At 7' it is shown that the restraining-magnet arrangement in the ledge 6 can be identical or similar, respectively in any case functionally identical with the one in ledge 43.

I claim:

1. An arrangement for applying substances to a web of material comprising:

a working magnet positioned below an application surface;

a profiled ledge positioned over said application surface;

a doctor device which is magnetically pressed against said application surface and when in an operating position rests against said profiled ledge; and at least one restraining magnet which is provided within said profiled ledge for keeping said doctor device in rolling or sliding contact with said profiled ledge and for lifting said restraining magnet off said application surface when said working magnet is switched off.

2. An arrangement according to claim 11 wherein said restraining magnet is a permanent magnet.

3. An arrangement according to claim 11 wherein said doctor device is a roller or a spreading bar.

4. An arrangement according to claim 1 wherein said profiled ledge is formed with a support surface against which said doctor device rests, said support surface having grooves formed therein.

5. An arrangement according to claim 1 wherein said doctor device has a structured surface.

6. An arrangement according to claim 1 wherein said profiled ledge is rotatable.

7. An arrangement according to claim 1 wherein said doctor device is in a roll form and is nonrotatably fastened by means of a pinned fitting to a holder, said holder being attached to said profiled ledge.

8. An arrangement according to claim 1 wherein said profiled ledge has a recess whose opening faces downward toward said application surface and within said recess said doctor device is mounted.

9. An arrangement according to claim 8 wherein said recess is in a form of a cage-like mounting support formed within said profiled ledge laterally rearward of said at least one restraining magnet.

10. An arrangement according to claim 8 wherein at least one of said restraining magnets is positioned above said recess and opposite a mouth of said recess.

11. An arrangement according to claim 8 wherein said recess is built like a friction bearing and envelopes a major portion of a surface of said doctor device.

12. An arrangement according to claim 8, further comprising a supplementary ledge mounted in said recess of said profiled ledge, said supplementary ledge and said profiled ledge having respective pairs of upright walls confronting one another.

13. An arrangement according to claim 8 wherein said doctor device is surrounded within said recess by two restraining magnets.

14. An arrangement according to claim 8 wherein said recess surrounds more than half of a circumferential surface of said doctor device, said arrangement further comprising another doctor device positioned along an outer surface of said profiled ledge not encompassed within said recess.

15. An arrangement according to claim 14 wherein one of said doctor devices can be brought into a working position while the other of said doctor devices is caused to move into a rest position through rotation of said profiled ledge.

16. An arrangement according to claim 14 wherein said working magnet has a sufficiently wide magnetic field so as to operatively move both of said doctor devices.

17. An arrangement for applying substances to a web of material comprising:

a working magnet positioned below an application surface;

a profiled ledge having a front and a rear arm parallel to one another positioned over said application surface;

a doctor device which is magnetically pressed against said application surface by said working magnet in a working position and sealingly pressed against one of said two arms so that escape is prevented of said substances to be applied from an area located in front of said doctor device to an area behind said doctor device when considered in a direction of travel; and a baffle ledge being vertically movable toward and away from said application surface, said baffle ledge bridging between said front and rear arms of said profiled ledge, positioned above said doctor device and movable sealingly against at least one of said arms.

18. An arrangement according to claim 17 wherein a crossbar is connected to one of said arms, said crossbar being positioned above said baffle ledge, and a means being provided for height-adjusting said profiled ledge relative to said application surface, said profiled ledge being connected via said crossbar to said height-adjusting means.

19. An arrangement according to claim 17 wherein said doctor element can be brought to adhere sealingly to a surface of said profiled ledge by a means which supports and allows said profiled ledge to be rotated.

20. An arrangement according to claim 17 wherein a free-motion space is located between said arms and below said baffle ledge, and wherein a plug-in profile is arranged within said free-motion space, said plug-in profile functioning to secure a means for holding said doctor device.

21. An arrangement according to claim 17 wherein said baffle ledge has means for rendering said baffle ledge easily removable from between said front and rear arms.

22. An arrangement according to claim 17 wherein said doctor device is in the form of a roll.

23. An arrangement according to claim 17 wherein said doctor device is a bar.

24. An arrangement according to claim 17 wherein said baffle ledge totally surrounds a first end of said doctor device and at least an opposite end relative to said first end of said doctor device is formed with an elastic edge.

25. An arrangement according to claim 17 wherein at least one permanent magnet is lodged within said profiled ledge or baffle ledge for purposes of keeping said doctor device pressed against a surface of said profiled or baffle ledge before and after applying said substances to said web of material, and wherein said doctor device can be removed from a position which would cause interaction of said device with said application surface.

26. An arrangement according to claim 17 wherein said doctor device itself is a magnet and at least a portion of said profile ledge is formed of magnetizable parts.

27. An arrangement according to claim 17 wherein said doctor device is rendered bendable through means of incisions therein.

28. An arrangement according to claim 17 wherein at least two doctor devices are present, said devices being nonrotatable, in touch with one another and arranged one on top of the other.

29. An arrangement according to claim wherein said doctor device and said baffle ledge contact one another and each is also in pressing contact against said rear arm.

30. An arrangement according to claim 28 wherein two said doctor devices are present, said devices being narrow and positioned next to one another with both being magnetically pressed against a surface of said profiled ledge.

31. An arrangement according to claim 17 wherein said profiled ledge is fitted with an elastic working edge adjacent said application surface and is deformable when there is a change in a working force applied thereto, said elastic working edge being located at an opening of a recess within said profiled ledge, so that an angle opening into said recess is varied.

32. An arrangement according to claim 17 wherein a lowermost edge of said baffle ledge is nearer said application surface than a lowermost edge of said front arm.

* * * * *